US010010151B2

(12) United States Patent
Gueret

(10) Patent No.: US 10,010,151 B2
(45) Date of Patent: Jul. 3, 2018

(54) PACKAGING AND APPLICATOR DEVICE FOR APPLYING A COSMETIC COMPOSITION TO THE LIPS

(75) Inventor: Jean-Louis Gueret, Paris (FR)

(73) Assignee: L'OREAL S.A., Paris (FR)

( * ) Notice: Subject to any disclaimer, the term of this patent is extended or adjusted under 35 U.S.C. 154(b) by 708 days.

(21) Appl. No.: 13/505,984

(22) PCT Filed: Nov. 2, 2010

(86) PCT No.: PCT/IB2010/054958

§ 371 (c)(1),
(2), (4) Date: Aug. 2, 2012

(87) PCT Pub. No.: WO2011/055299

PCT Pub. Date: May 12, 2011

(65) Prior Publication Data

US 2012/0312315 A1 Dec. 13, 2012

Related U.S. Application Data

(60) Provisional application No. 61/265,084, filed on Nov. 30, 2009.

(30) Foreign Application Priority Data

Nov. 4, 2009 (FR) ..... 09 57804

(51) Int. Cl.
*A45D 40/26* (2006.01)
*A45D 34/04* (2006.01)

(52) U.S. Cl.
CPC .... *A45D 34/045* (2013.01); *A45D 2200/1018* (2013.01)

(58) Field of Classification Search
CPC ..... A45D 40/26; A45D 40/265; A45D 40/267
(Continued)

(56) References Cited

U.S. PATENT DOCUMENTS 1,782,911 A 11/1930 Scrimgeour
2,199,720 A * 5/1940 Catelin ..... A45D 40/30 132/320

(Continued)

FOREIGN PATENT DOCUMENTS

EP 0 728 426 A1 8/1996
EP 0 823 228 A1 2/1998

(Continued)

OTHER PUBLICATIONS

International Search Report and the Written Opinion for International Application No. PCT/IB2010/054958 dated Dec. 14, 2010.

(Continued)

*Primary Examiner* — Todd E Manahan
*Assistant Examiner* — Brianne Kalach
(74) *Attorney, Agent, or Firm* — Jones Robb, PLLC

(57) ABSTRACT

The present invention relates to a packaging and applicator device (1) for applying a cosmetic or a care-product composition to the lips, the device comprising: • a container (2) containing the composition for application to the lips; and • an applicator member (6) that defines two opposite main application faces (11) that generally converge towards the distal end of the applicator member, for applying the composition to the user's bottom and top lips simultaneously; a greatest thickness of the applicator member, measured between the two main application faces, being greater than or equal to 4 mm, the greatest width of said main faces lying in the range 4 mm to 15 mm.

14 Claims, 4 Drawing Sheets

(58) Field of Classification Search
USPC ..... 132/216–218, 318, 320
See application file for complete search history.

(56) References Cited

U.S. PATENT DOCUMENTS

| | | | | |
|---|---|---|---|---|
| 2,218,862 | A * | 10/1940 | Vredenburgh | 15/209.1 |
| 5,716,150 | A * | 2/1998 | Gueret | A45D 40/267 401/128 |
| 5,803,638 | A | 9/1998 | Gueret | |
| 6,070,598 | A | 6/2000 | Gueret | |
| 6,076,534 | A * | 6/2000 | Gueret | A45D 40/26 132/317 |
| 6,220,254 | B1 | 4/2001 | Gueret | |
| 6,280,112 | B1 * | 8/2001 | Vieu | 401/122 |
| 6,328,495 | B1 | 12/2001 | Gueret | |
| 6,343,608 | B1 | 2/2002 | Gueret | |
| 6,375,374 | B2 | 4/2002 | Gueret | |
| 7,455,468 | B2 | 11/2008 | Gueret | |
| 7,677,826 | B2 | 3/2010 | Gueret | |
| 7,866,327 | B1 | 1/2011 | Gueret | |
| 2002/0048481 | A1 | 4/2002 | Gueret | |
| 2004/0258453 | A1 | 12/2004 | Gueret | |
| 2005/0028834 | A1 | 2/2005 | Ramet | |
| 2005/0175394 | A1 | 8/2005 | Gueret | |
| 2006/0013639 | A1 * | 1/2006 | Gueret | A45D 34/045 401/130 |
| 2006/0065282 | A1 * | 3/2006 | Hartstock et al. | 132/320 |
| 2007/0020027 | A1 * | 1/2007 | Gueret | A45D 40/262 401/130 |
| 2008/0317542 | A1 | 12/2008 | Gueret | |

FOREIGN PATENT DOCUMENTS

| | | | |
|---|---|---|---|
| EP | 1 053 695 | A2 | 11/2000 |
| EP | 1 195 105 | A1 | 4/2002 |
| EP | 1 623 650 | A2 | 2/2006 |
| EP | 1 726 235 | A2 | 11/2006 |
| EP | 1 745 717 | A2 | 1/2007 |
| EP | 2 016 855 | A1 | 1/2009 |
| FR | 752 860 | A | 10/1933 |
| FR | 2 868 312 | A1 | 10/2005 |
| FR | 2 872 999 | A1 | 1/2006 |
| FR | 2 886 112 | A1 | 12/2006 |

OTHER PUBLICATIONS

Preliminary French Search Report for French Application No. 0957804 dated Nov. 4, 2009.

* cited by examiner

PACKAGING AND APPLICATOR DEVICE FOR APPLYING A COSMETIC COMPOSITION TO THE LIPS

This is a national stage application of International Application No. PCT/IB2010/054958, filed internationally on Nov. 2, 2010, which claims priority to French Application No. 957804, filed on Nov. 4, 2009, and to U.S. Provisional Patent Application No. 61/265,084, filed on Nov. 30, 2009, each of which is incorporated by reference herein in its entirety.

The present invention relates to packaging and applicator devices for applying a composition to the lips. The composition may be a cosmetic or a care-product composition, in particular makeup, e.g. lipstick, lip gloss, or a care product.

The invention relates more particularly, but not exclusively, to devices in which the applicator comprises an applicator member for applying the composition, which applicator member is carried by a stem, and is inserted into a container for loading with composition.

U.S. Pat. No. 6,070,598 discloses a lipstick applicator having an applicator member that presents a portion having an envelope surface of generally cylindrical shape, configured to provide regions that are not wiped after the applicator member has passed through the wiper member. It enables composition to be applied to one lip at a time, while taking advantage of the supplies of composition present on the non-wiped regions. A greatest diameter of the applicator member lies in the range 2 millimeters (mm) to 6 mm, with said diameter preferably being about 3 mm.

European patent application EP 2 016 855 discloses devices in which the applicator includes an applicator member having an end face that is substantially plane and substantially parallel to the longitudinal axis of the distal portion of the stem, for applying a composition to one lip at a time.

European patent application EP 1 053 695 discloses devices in which the applicator member presents a distal end that is offset from the longitudinal axis of the distal portion of the stem, so as to enable the applicator member to be wiped in non-uniform manner, thereby making it possible to accumulate more composition on one side of the applicator member than on the other. Such an applicator member is provided for applying the composition to a user's two lips in succession.

U.S. Pat. No. 6,220,254 describes an applicator for applying composition to the lips, which applicator includes an applicator member of asymmetrical shape.

European patent application EP 1 195 105 relates to a device for applying a lipstick, which device includes an applicator member presenting a beveled portion.

Patent applications EP 1 623 650 and FR 2 886 112 disclose applicators for applying composition to the lips, which applicators include applicator members having two branches that define a cavity for receiving the composition. In one embodiment, the applicator member presents top and bottom faces that converge towards the distal end of the applicator member, at least along a fraction of the cavity. Such applicators are designed for applying the composition to one lip at a time.

Application EP 1 745 717 discloses an applicator for the lips, which applicator includes a hinge-forming thin zone that enables a portion of the applicator member to pivot relative to the remainder of the applicator during application.

None of those devices, provided for applying composition to one lip at a time, enables makeup to be applied as quickly as desired.

Patent application EP 0 823 228 relates to a device for applying makeup to the lips, which device includes an applicator portion of flat shape for pressing between the lips. The thickness of the applicator portion may lie in the range 0.4 centimeters (cm) to 2 cm, and its width may lie in the range 4 cm to 8 cm. Such a device enables the composition to be applied to both lips quickly and simultaneously. However, such a device does not enable makeup to be applied as accurately as desired, in so far as it does not adapt to each individual's lips. From one corner of the lips to the other, the peripheral shape of the lips varies greatly from one individual to another.

Application FR 2 868 312 describes a device for use in similar manner and formed by a patch of thickness that is greater than or equal to 4 mm.

Patent FR 752 860 relates to a lipstick applicator having a shape that corresponds to the entire shape of the lips.

There exists a need to improve still further packaging and applicator devices that are used for applying a composition to the lips.

There exists a need to have an applicator that is adaptable to lip profiles that differ from one corner to the other, and that makes it possible to improve the speed of application.

In particular, there is an advantage to having an applicator that makes it possible to apply a composition to the lips in quick and accurate manner.

Exemplary embodiments of the invention thus provide a packaging and applicator device for applying a cosmetic or a care-product composition to the lips, the device comprising:

- a container containing the composition for application to the lips; and
- an applicator member that defines two opposite main application faces that generally converge towards the distal end of the applicator member, said faces being suitable for coming into contact with the bottom and top lips simultaneously, so as to apply the composition to the user's bottom and top lips simultaneously;

a greatest thickness of the applicator member, measured between the main application faces, being greater than or equal to 4 mm, the greatest width of the applicator member being less than or equal to 15 mm, or lying in the range 4 mm to 15 mm.

The applicator member is thick enough to enable the user's bottom and top lips to come into contact with respective main application faces, when the applicator member is used. However, the applicator member remains narrow enough to enable makeup to be applied accurately by moving the applicator member relative to the lips. Thus, the composition may be applied relatively quickly, with both lips being made-up simultaneously, and with the makeup being applied relatively uniformly.

Furthermore, in the invention, the composition is applied by moving the applicator member between the user's bottom and top lips, thereby enabling the user to use a hand movement that is similar to the hand movement normally used for applying composition to the lips.

The applicator member preferably comprises flocking, but, in a variant, it may be deprived of flocking.

Whether flocking is to be present or absent may be determined as a function of the rheology of the composition, for example. The dimensions given above include flocking.

The term "main application face" should be understood to mean a surface of the applicator member that is suitable for coming into contact with a lip, so as to apply the composition thereto. A main application face may be plane, concave, or convex. A main application face may possibly present a concave recess, having a depth that is less than or equal to 1 mm, for example.

The term "opposite main application faces" should be understood to mean that one of the faces is oriented substantially upwards and the other substantially downwards, when the applicator is observed from the side.

The applicator member may be mounted at the end of a stem that is secured at its other end to a handle that is configured to close the container.

The applicator member may extend along a longitudinal axis that forms an angle relative to a longitudinal axis of the stem.

The applicator member may present a main application face that is concave on the side towards which the applicator member slopes.

At least one of the main application faces may be plane or outwardly concave.

The application faces may form an angle between them, e.g. an acute angle, that is greater than 20°, better lying in the range 20° to 40°, e.g. about 30°. The angle is measured between the tangents to the main application faces.

The above-mentioned greatest thickness may be greater than 4.5 mm, or even greater than 5 mm or 7 mm, while preferably remaining less than 12 mm.

The thickness measured between the main application faces, when the applicator member is observed from the side in a direction of observation that is perpendicular to the direction along which the thickness is measured, may increase in monotonic manner, and may pass through a single maximum that is equal to the above-mentioned greatest thickness.

The section of the applicator member in which the thickness is at its maximum may correspond to the section that presents a greatest diameter of the applicator member.

The applicator member may present, in the plane in which the thickness reaches the maximum value, a cross-section that is circular.

At its rear, e.g. behind this plane, and in the portion of the applicator member connected to the stem, the applicator member may present an envelope surface that corresponds to a portion of a sphere, e.g. a hemisphere. The hemispherical shape makes it possible to avoid the applicator member coming into contact with the skin surrounding the lips. Makeup may thus be applied more accurately.

The thickness of the applicator member, measured at a distance from its distal end that is equal to 1 mm, 4.5 mm, and 9 mm, may be greater than 0.5 mm, 2 mm, and 5 mm respectively, e.g. about 0.8 mm, 2.5 mm, and 5.5 mm respectively.

The values may correspond to an applicator that is not flocked.

In the presence of flocking, the thickness may be about 2.5 mm, 4.5 mm, and 7.5 mm, including flocking, and the width may be about 3 mm, 5.5 mm, and 7.5 mm at 1 mm, 4.5 mm, and 9 mm respectively from the distal end.

Ignoring flocking, the length of the applicator member may be about 12.5 mm, for example, and with flocking it may be about 14.5 mm, for example. The applicator member may present various shapes in cross-section, and, over at least a fraction of its length, it may for example present a cross-section that is circular, non-circular, polygonal, or flat, amongst others.

The applicator member may present an envelope surface that is optionally a surface of revolution. The applicator member may present an envelope surface of shape that is symmetrical about a mid-plane, in particular a mid-plane containing the longitudinal axis of the applicator member.

The thickness may increase in monotonic manner, and may pass through a single maximum on going away from the distal end.

The applicator member may present, in the plane in which the thickness reaches the maximum value, a cross-section that is circular.

The two faces of the applicator member may be solid. The applicator member may thus present an outside surface that does not have a cavity.

The applicator member preferably comprises a cavity. When the cavity is made so as to be suitable for being loaded with composition, it may constitute a supply of composition, thereby enabling the applicator member to be used for a greater length of time or enabling a greater quantity of substance to be deposited more easily, so as to reinforce a makeup effect, e.g. the glossiness of a gloss.

The cavity may open out to one or both of the main application faces of the applicator member. The cavity may be a through hole.

Where appropriate, the presence of the cavity makes it possible to impart flexibility to the applicator member. However, the applicator member does not have a hinge-forming thin zone.

The applicator member may comprise two branches that define the cavity. In cross-section, the branches may present a shape that is circular; oblong, e.g. elliptical; polygonal, having optionally-rounded vertices, e.g. triangular, square, or rectangular. The branches may be hollow, where appropriate.

The branches may optionally be completely flocked.

The cavity may present a closed outline in at least one plane. The applicator member may present a thickness of material around the cavity that is not constant. The cavity may extend over more than half the width of the applicator member, the width of the applicator member being considered in a direction that is perpendicular to the thickness. The cavity may extend over more than half the visible length of the applicator member. The term "visible length" should be understood to mean the length of the portion of the applicator member that is visible and that is used for application.

The applicator member may be magnetic or magnetizable.

The applicator member may be made without any metal, thereby enabling it to be placed in a microwave oven, for example.

The applicator member may comprise an injection-molded or machined body. It may be made out of: polyvinyl chloride (PVC); ethyl vinyl acetate (EVA); silicone rubber; nitrile rubber; ethylene-propylene terpolymer rubber (EPDM); butyl rubber; HYTREL®; PEBAX®; polyurethane (PU); polyethylene terephthalate (PET); polystyrene (PS); or any other thermoplastic and/or elastomer material. It may be supple, flexible, semi-flexible, or rigid.

The applicator member may comprise an endpiece that is engaged inside the above-mentioned stem.

The flocking may comprise bristles of the same kind or a mixture of bristles, e.g. bristles of different kinds and/or of different lengths. By way of example, the bristles of the flocking may have a length lying in the range 0.2 mm to 2.5 mm, or even in the range 0.5 mm to 2 mm.

The applicator member may be flocked over substantially all of its visible surface. In a variant, only the surface of the applicator member that is used for applying the composition may be flocked.

The handle of the applicator may be used as a closure member for closing the container, and may co-operate by screw-fastening with the container. The container may be closed in leaktight manner by the handle of the applicator.

The device may comprise a wiper member for wiping the applicator member, which wiper member makes it possible to wipe the stem completely, so as to keep said stem clean, and so as to impart thereto a satisfactory appearance for the user, while ensuring that the composition is distributed in satisfactory manner over the applicator member.

By way of example, the wiper member may be disposed in the neck of the container.

The wiper member may be made out of an elastomer material.

The wiper member may define a wiper orifice having a diameter that is smaller than the greatest dimension of the stem in cross-section.

The wiper member may define a wiper orifice that is: circular; non-circular; polygonal; undulating; or having slots that are radial or tangential to the wiper orifice.

The wiper orifice may possibly be defined by a lip that comprises undulations, enabling the wiper orifice to widen more easily when the applicator member passes therethrough, by means of the lip deploying. The number of undulations may lie in the range 3 to 12, for example. The wiper lip may extend generally along a cone that converges towards the bottom of the container, having a generator line that forms an angle relative to the longitudinal axis of the container. In a variant, the wiper lip may extend generally along a mid-plane that is perpendicular to the longitudinal axis of the device, or even along a cone that converges towards the outlet of the container.

The wiper member may also be made in some other way, e.g. it may comprise a block of foam that may be slotted.

The wiper member may be adjustable, where appropriate.

By way of example, the wiper member may be as defined in US patent applications or patents Nos. 2005/0028834, 2005/0175394, 2004/0258453, U.S. Pat. Nos. 6,375,374, 6,328,495, 7,455,468, the contents of which are incorporated herein by reference.

The stem is preferably relatively rigid, and does not deform in visible manner while being used for applying the composition.

The stem may comprise a constriction that is disposed level with the wiper member when the applicator is in place in the container, so as to preserve the wiper member at rest and not deform it.

The applicator may comprise marker means not on the applicator member itself, the applicator member having a predefined angular position relative to the marker means, such that the position of the applicator given by the marker means corresponds to a predefined position of the application faces relative to the user's lips.

By way of example, the marker means may be disposed on the handle. By way of example, the handle may comprise at least one flat, e.g. two flats, or even four flats, of position that corresponds to the two opposite application faces of the applicator member. The marker means may also comprise a visual indicator such as an inscription or a colored mark.

The device may be configured so as to enable the composition to be stirred while the applicator member is moving in the container. The applicator member may comprise one or more preferred passages, such as ridges or a screw thread, enabling the composition to pass between the applicator member and the inside surface of the container. The applicator member may be situated at a small distance from the inside surface of the container, so as to obtain the desired stirring. Such stirring makes it possible to mix together a plurality of phases of the composition prior to application, for example. By way of example, the phases may comprise a wax, a pigment, polymers, solvents, or oils.

In a variant, the device may comprise a scraper system having a chamber of variable volume, making it possible to empty a relatively large quantity of composition contained in the container and/or to mix different phases.

The applicator member may also be mounted at the end of a flexible tube or of a piston container, making it possible to supply the applicator member with composition, e.g. via a channel formed in said applicator member, the channel opening out in at least one of the two application faces of the applicator member, for example, and preferably to both of them.

Other exemplary embodiments of the invention also provide a method of applying makeup to the lips, the method comprising the following steps:

- bringing the main application faces of a device as defined above, into contact with both lips simultaneously; and
- moving the applicator member from one corner of the lips to the other, so as to apply the composition to the bottom and top lips simultaneously.

It is possible to perform only a single back and forth movement between the lips.

The user may press the lips against each of the two application faces.

In an additional step, the lips may also be pressed, together after removing the applicator.

The invention can be better understood on reading the following detailed description of non-limiting embodiments thereof, and on examining the accompanying drawings, in which.

Figure 1:
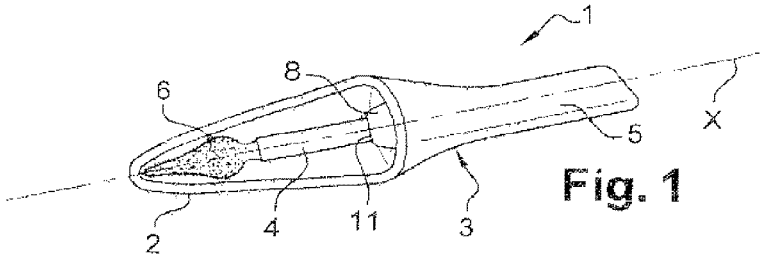
FIG. 1 is a diagrammatic and fragmentary perspective view of an example of a packaging and applicator device in accordance with the invention.

FIG. 1 shows a packaging and applicator device 1 comprising a container 2 and an applicator 3.

The container 2 contains a composition P for application to the lips, e.g. a liquid lipstick, a lip gloss, or a care product.

The applicator 3 comprises a stem 4 that is connected at its proximal end to a handle 5, and at its distal end to an applicator member 6, as shown in greater detail in FIGS. 2 to 6.

The handle 5 constitutes a closure member for closing the container 2 in leaktight manner, and, by way of example, includes an internally-threaded skirt that is configured in such a manner as to screw-fasten on the neck of the container 2 that may include a corresponding external thread.

The device 1 may further include a wiper member 8 that is fastened in the neck of the container 2.

In the embodiment described, the stem 4 presents a cross-section that is circular, but it would not be beyond the ambit of the present invention if this were otherwise, in particular if the cross-section of the stem were oval, elliptical, or polygonal, e.g. square, rectangular, or triangular. The stem 4 may be solid or hollow. The greatest outside diameter of the stem 4 lies in the range 3 mm to 6 mm, for example, with said diameter being about 4 mm or 5 mm, for example. The stem 4 may be relatively short. The visible length of the stem may lie in the range 10 mm to 40 mm, for example.

The applicator member 6 comprises a body 9 that is preferably covered by flocking.

At least some, and preferably all, of the body 9 may be made by molding, e.g. by injection-molding, out of a material selected for example from the following list: thermoplastic material; thermoplastic elastomer; thermoplastic elastomer polyester, such as HYTREL® for example; nitrile rubber; silicone rubber; EPDM; styrene-ethylene-butylene-styrene (SEES); styrene-isoprene-styrene (SIS); PU; EVA; PVC; polyethylene (PE); PET; and polypropylene (PP); this list not being limiting.

At least part of the body 9 may be made from a material that is more flexible than a material from which the stem is made.

Where appropriate, the applicator member 6 may be magnetic, e.g. the body 9 may contain particles having a non-zero magnetic susceptibility.

The applicator member 6 defines two opposite main application faces 11, 12 that make it possible to apply the composition to the bottom and top lips L simultaneously.

The applicator member 6 presents a greatest thickness T that is greater than or equal to 4 mm, including flocking.

Figure 3:
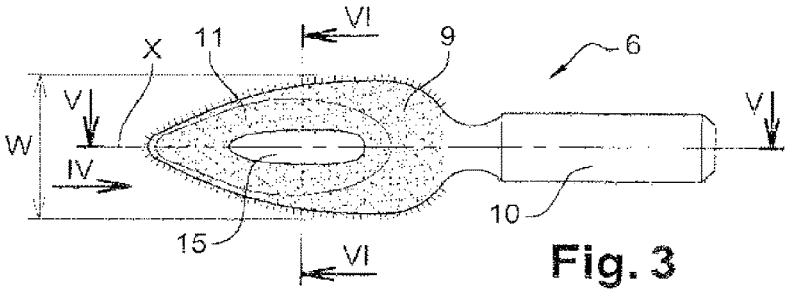
FIG. 3 is a plan view as seen looking along arrow III in FIG. 2.
Figure 5:
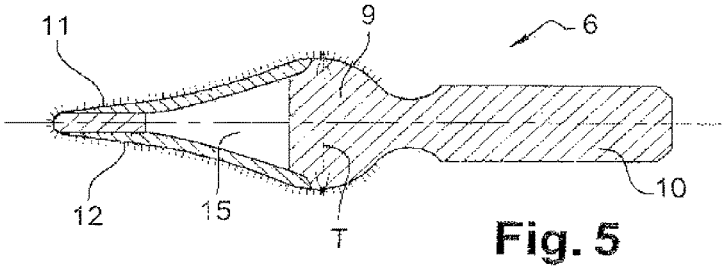
FIG. 5 is a longitudinal section on-V-V in FIG. 3.
Figure 6:
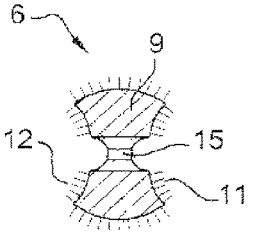
FIG. 6 is a cross-section on. VI-VI in FIG. 3.

The applicator member 6 may have a thickness t that continuously increases on going away from the distal end, then decreases. The thickness t may reach a greatest thickness T lying in the range 4 mm to 12 mm, including flocking, with said thickness being about 7.5 mm, for example. The width W may continuously increase on going away from the distal end, then decrease, as can be seen in FIG. 3.

The thickness is a distance measured between the two opposite application faces, whereas the width is a dimension that is perpendicular to the thickness, measured in a plane that is parallel to one of the application faces. The width w may reach a greatest width W lying in the range 4 mm to 15 mm. The width w varies differently from the thickness t. In this embodiment, the greatest. width W and the greatest thickness T are observed in the same cross-section perpendicular to the longitudinal axis of the applicator member.

The shapes of the application faces 11, 12 may be identical or different.

Each of the two application faces 11 and 12 may be of generally concave shape, as shown.

The application faces 11, 12 may slope relative to the longitudinal axis X of the applicator member by respective angles $\beta_1$, $\beta_2$.

Figure 2:
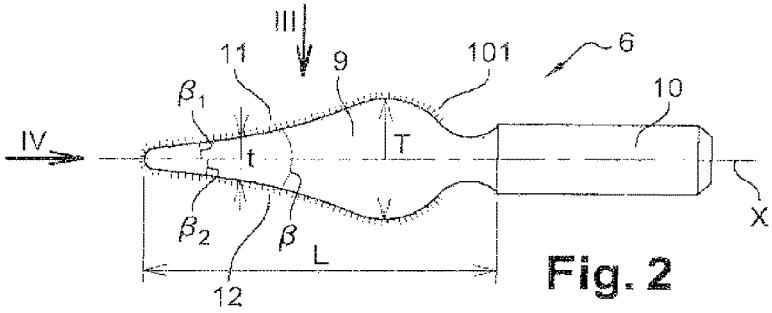
FIG. 2 is a side view of the FIG. 1 applicator member shown in isolation.

In the embodiment shown in FIG. 2, the angles $\beta_1$, $\beta_2$ are equal. The angle $\beta=\beta_1+\beta_2$ between the faces 11 and 12 may lie in the range 15° to 45°, and in particular may be about 30°.

As shown, in the embodiment described, the applicator member 6 may advantageously include a cavity 15 that is a through hole opening out in each of the application faces 11, 12, and that enables the applicator to be used for a greater length of time.

The body 9 may have a thickness E having a maximum value lying in the range 3 mm to 10 mm, with said thickness being about 5.5 mm, for example.

The thickness E of the body may be at its maximum where the applicator member presents the greatest thickness T, when the length of the flocking bristles is uniform.

The visible length L of the applicator member, measured outside the stem 4, may lie in the range 5 mm to 25 mm, or even in the range 10 mm to 16 mm, and may be about 13 mm, for example.

The applicator member 6 may include a rounded distal end of semi-spherical shape having a radius of curvature of about 0.5 mm, for example.

Figure 4:
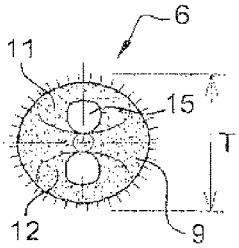
FIG. 4 is a front view as seen looking along arrow IV in FIGS. 2 and 3.

The section of the applicator member in which the thickness t is at its maximum may be circular, as can be seen in FIG. 4.

The surface 101 behind this maximum section may be a portion of a sphere.

The body 9 of the applicator member 6 may be molded integrally with a fastener endpiece 10 for being received in a corresponding housing of the stem 4.

The applicator member 6 may be fastened to the stem 4 by adhesive, by heat-sealing, by force-fitting, by snap-fastening, by crimping, or by screw-fastening. In a variant, the body 9 may be made integrally with the stem 4, e.g. out of the same material or out of different materials, e.g. by bi-injection.

Where appropriate, the handle 5 may include at least one reception zone, e.g. a cavity or a flat, for receiving a finger, which zone may extend on the same side as one of the two application faces 11 and 12, for example. As shown in FIG. 1, the handle 5 may include two opposite reception zones for receiving the fingers, each being situated on the same side as one of the application faces. This makes it easier for the user to identify the orientation of the applicator member relative to the lips.

An applicator member as shown in FIGS. 2 to 6 has for example the following manufacturing dimensions for the body 9:

- diameter of the endpiece 10: 3 mm;
- greatest diameter of the body 9: 6.1 mm;
- diameter at 8 mm from the distal end: 5.5 mm;
- radius of curvature of the body 9 at the main application faces: 34 mm;
- radius of curvature in plan view, as seen looking along arrow III, of the sides of the body: 15 mm;
- length of the cavity 15, ignoring flocking: 5 mm;
- distance of the cavity from the distal end, ignoring flocking: 3 mm;
- depth of the hollows formed by the concave shapes of the body in the main faces, outside the cavity: 0.5 mm; and
- outline of the cavity in plan view, as seen looking along arrow III, ignoring flocking, defined by two longitudinal edges of radius of curvature 10 mm, joined at the distal end by a rounded wall with a radius of curvature 0.2 mm, and at the proximal end by a rounded wall with a radius of curvature of 0.6 mm.

Naturally, the dimensions correspond to only one example amongst others, and each dimension may be modified independently of the others.

Use of the applicator is described below in greater detail.

Figure 7:
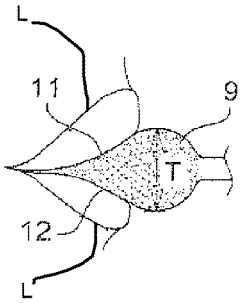
FIG. 7 shows the use of the applicator member in FIGS. 1 to 6.

Initially, the above-described applicator member is disposed between the lips L. Each of the lips L comes into contact with one of the two application faces. The closed lips L, without being pressed together, form a corresponding space that is substantially in the shape of the applicator member, as shown in FIG. 7.

In so far as the lips L present, in plan view, ends that are set back from the central portion, they form an inlet and an outlet for the applicator member, making it easier to put said applicator member into place between the bottom and top lips L.

Application may even be performed without a mirror. Along the path of the applicator member, from one corner to the other, the user pushes in the applicator member between the lips L to a greater or lesser extent, so as to adapt to the profile of the lips L.

The applicator member is then moved from one corner of the lips L to the other, so as to apply the composition to the bottom and top lips L simultaneously.

Only one back and forth movement may be needed to be performed.

In a variant, a plurality of passes may be performed so as to apply a greater quantity of composition, or so as to apply a plurality of layers.

Finally, the user may press the lips L together after removing the applicator, so as to improve still further the uniformity with which the makeup is applied.

FIGS. 8 to 12 show an embodiment that includes an endpiece 10 of longitudinal axis Y that slopes relative to the longitudinal axis X of the applicator member 6, such that the axis X of the applicator member slopes relative to the stem by an angle $\alpha$, when said member is in place in said stem.

In addition, the embodiment shown in FIGS. 8 to 12 differs from the embodiment shown in FIGS. 2 to 6 in so far as it includes two application faces 11, 12 of different shapes, one 11 being concave and the other 12 being plane. In addition, the body 9 is not flocked.

The concave face 11 is situated on the side of the applicator member towards which the endpiece 10 slopes.

Figure 8:
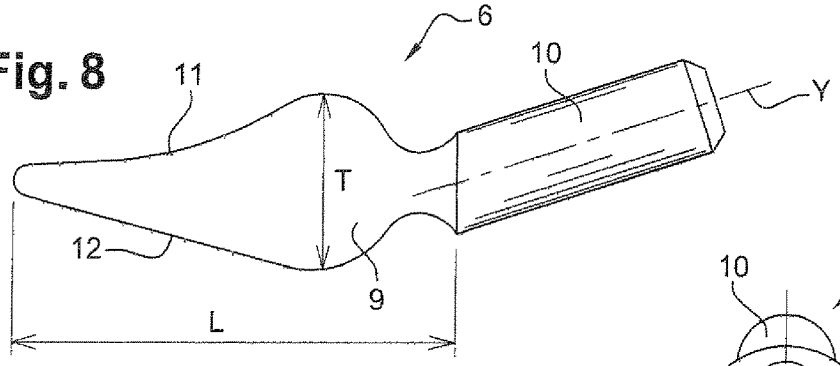
FIGS. 8 to 12 are views similar to FIGS. 2 to 6 of a variant embodiment of the invention.
Figure 10:
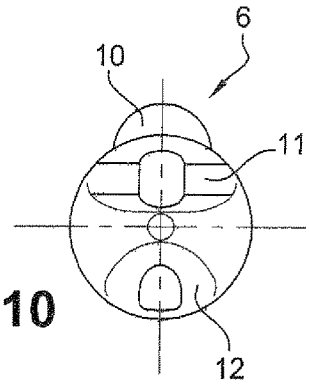
Figure 9:
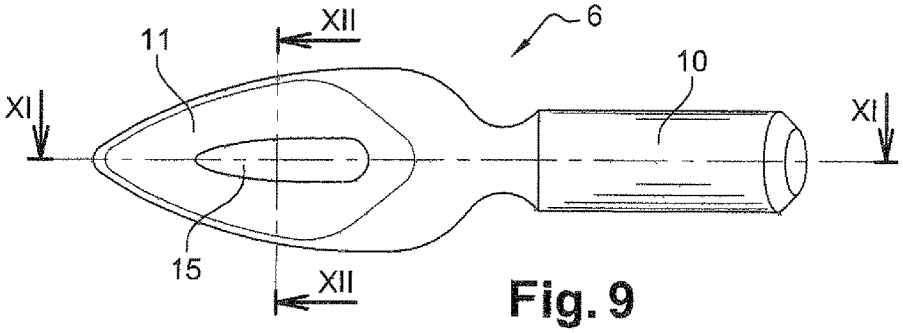
Figure 12:
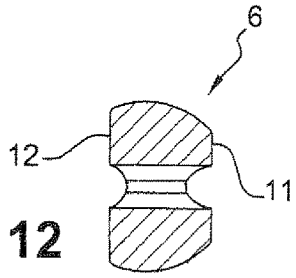
Figure 11:
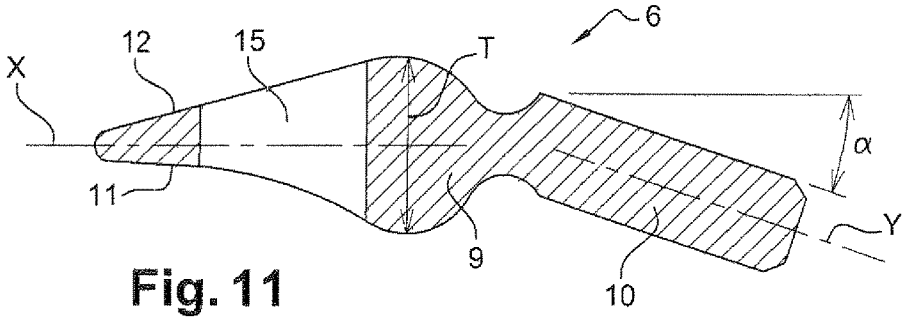

By way of example, the applicator member in FIGS. 8 to 12 has the following manufacturing dimensions:

radius of curvature of the concave face, in side view as in FIG. 8: 22 mm over 5.5 mm, starting from a point that is 0.5 mm away from the distal end;

angle of the endpiece 10 relative to the axis X: 18°; and the plane face extends over 8.48 mm along the axis, starting from a point that is 0.5 mm away from the distal end.

Figure 13:
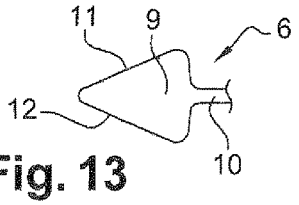
FIGS. 13 & 15 and FIGS. 14 & 16 are views similar respectively to FIGS. 2 and 4 showing variant embodiments.
Figure 15:
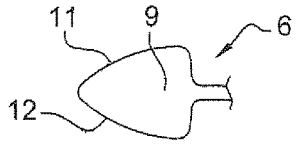
Figure 14:
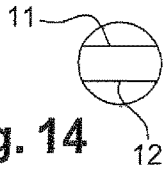
Figure 16:
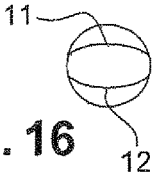

In a variant embodiment, the applicator member 6 includes two plane application faces 11, 12, as shown in FIGS. 13 and 14, or even one or two convex application faces, as shown in FIGS. 15 and 16.

Figure 17:
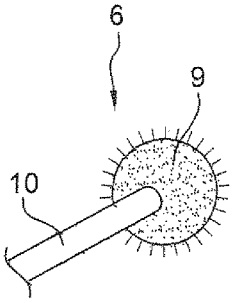
FIGS. 17 and 18 are diagrammatic and fragmentary perspective views of variant embodiments.

The applicator member 6 may have a substantially spherical shape, as shown in FIG. 17, that is smooth or ridged. It may optionally be flocked. In this embodiment, the diameter of the body of the applicator member may be less than 10 mm, e.g. about 5.5 mm, excluding flocking, if any.

For an applicator member of substantially spherical shape, the user's lips may deform on coming into contact with the applicator member, so as to fit around the periphery of the applicator member.

Figure 18:
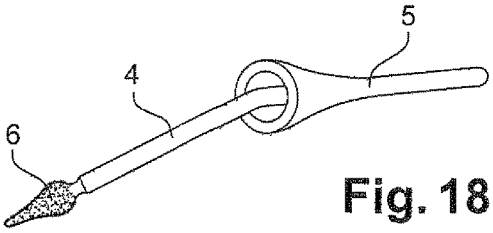

The stem 4 may be of longitudinal axis that is rectilinear, as shown, or, in a variant, it may be curved or sloping. By way of example, FIG. 18 shows a stem 4 that slopes on leaving the handle 5.

In the embodiment, shown in FIG. 1, the wiper member 8 includes a flexible lip that defines a wiper orifice 11 of dimension adapted to wipe the applicator member 6 and the stem 4. The wiper member may have a wiper lip that is optionally undulating, optionally slotted, and/or optionally adjustable.

Figure 19:
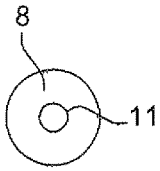
FIGS. 19 to 22 show variant embodiments of wiper members.
Figure 20:
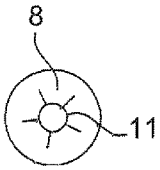
Figure 21:
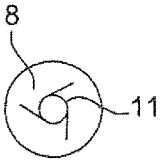
Figure 22:
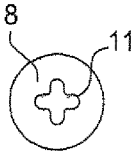

FIG. 19 shows a wiper orifice 11 that is circular, FIGS. 20 and 21 show a wiper member having slots, respectively extending radially and tangentially relative to the wiper orifice, and FIG. 22 shows a wiper member having a lip that is undulating.

Figure 23:
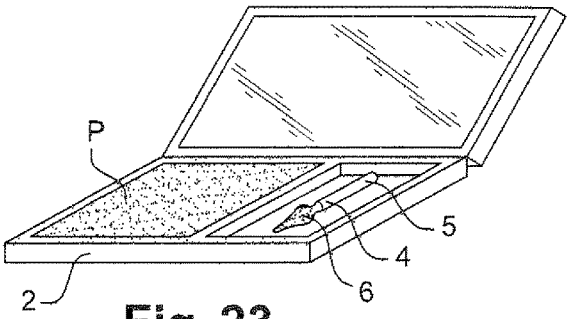
FIG. 23 is a diagrammatic and fragmentary perspective view of a variant embodiment.

In another variant embodiment shown in FIG. 23, the handle 5 of the applicator does not act as a closure member for closing the container containing the composition. It can be seen in this figure that the composition may be contained in a compact, e.g. in the form of a cast lipstick. The compact may house the applicator.

Figure 24:
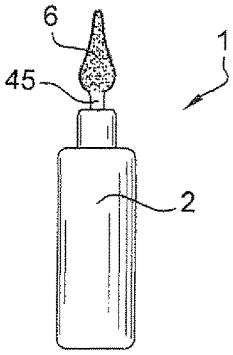
FIG. 24 is an elevation view of a variant device of the invention.

FIG. 24 shows a variant device in which, during application, the applicator member 6 is secured to the container 2 containing the composition.

Figure 25:
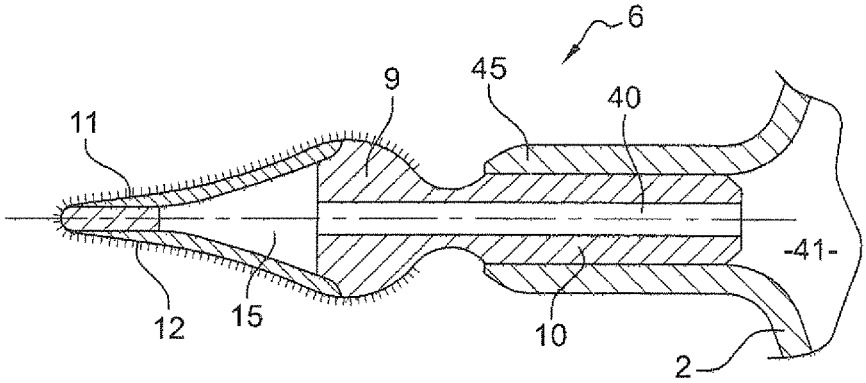
FIG. 25 shows the applicator member of the FIG. 24 device.

As shown in FIG. 25, the applicator member 6 may include an inner channel 40 that communicates at one end with a space 41 containing the composition, inside the container 2, and that opens out at the other end into the cavity 15.

By way of example, the container 2 is made with a flexible wall so that the user may squeeze its wall to force the composition to flow through the channel 40, so as to supply the application faces 11 and 12.

Figure 26:
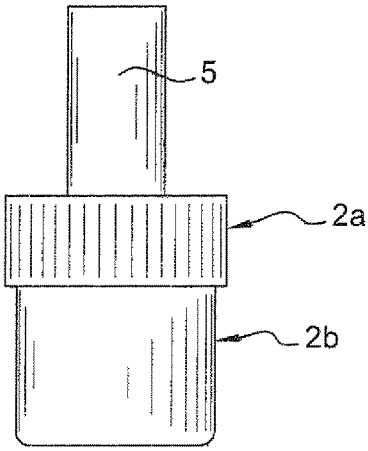
FIGS. 26 and 27 show variant containers that are suitable for receiving the applicator member.

By way of example, the endpiece 10 is inserted into a neck 45 of the container 2.

Where appropriate, and in accordance with the teaching of US application No. 2005/0232681, the container may be made with two portions 2*a* and 2*b* that can turn relative to each other about the longitudinal axis of the container, as shown in FIG. 26. By way of example, the portions 2*a* and 2*b* define two chambers of variable volume inside the container, and turning one of the portions 2*a* or 2*b* relative to the other causes the volume of one of the chambers to decrease and the composition to pass from this chamber into the other chamber. The applicator member 6 may be positioned on the path of the composition.

Figure 27:
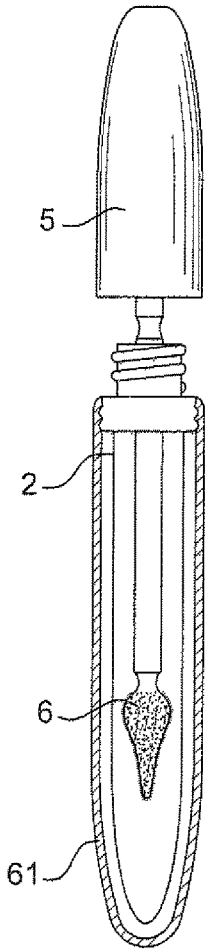

As shown in FIG. 27, the container 2 may also be made with an inside diameter that corresponds substantially to the outside diameter of the applicator member 6. By way of example, the applicator member 6 comes into contact with the inside surface of the container, or is situated at a small distance therefrom, e.g. a distance that is less than or equal to 1 mm. By way of example, the container and the applicator member are made in accordance with the teaching of application FR 08/54011. By way of example, the container 2 is a double-walled container with an outer cover 61.

Naturally, the invention is not limited to the embodiments described above. The characteristics of the embodiments shown may be combined within variants that are not shown.

The applicator member could alternatively be made of glass, metal, or wood, for example.

The expression "comprising a" should be understood as being synonymous with "comprising at least one" unless specified to the contrary

The invention claimed is:

1. A method of applying makeup to lips, the method comprising:

bringing two opposing main application faces of a device into contact with both bottom and top lips simultaneously; and moving an applicator member of the device from one corner of the lips to the other corner of the lips, in order to apply a composition to the bottom and top lips simultaneously, the device being configured to apply a cosmetic or a care-product composition to the lips, the device comprising:

a container containing the composition for application to the lips; and the applicator member defining the opposing main application faces, wherein the opposing main application faces, prior to the bringing into contact with both bottom and top lips simultaneously, converge toward a distal end of the applicator member and have an outwardly concave profile, the outwardly concave profile extending from the distal end of the applicator member, wherein a greatest thickness of the applicator member measured between the two main application faces is greater than or equal to 4 mm, wherein a greatest width of the application faces ranges from 4 mm to 15 mm.

2. A method according to claim 1, wherein moving the applicator member comprises a single back and forth movement between the lips.

3. A method according to claim 1, wherein the greatest thickness is greater than 7 mm.

4. A method according to claim 1, wherein a thickness of the applicator member, measured at a distance from the distal end of the applicator member that is equal to 4.5 mm, is greater than 2 mm.

5. A method according to claim 1, wherein a thickness of the applicator member, measured at a distance from the distal end of the applicator member that is equal to 9 mm, is greater than 5 mm.

6. A method according to claim 1, wherein the applicator member is mounted at a first end of a stem, and wherein a second end of the stem is secured to a handle that is configured to close the container.

7. A method according to claim 1, wherein the applicator member extends along a longitudinal axis that forms an angle relative to a longitudinal axis of a stem.

8. A method according to claim 1, wherein the container comprises a wiper member for wiping the applicator member.

9. A method according to claim 1, wherein the greatest thickness of the applicator member is greater than 5 mm.

10. A method according to claim 1, wherein a thickness of the applicator member, measured at a distance from its distal end that is equal to 1 mm, is greater than 0.5 mm.

11. A method according to claim 1, wherein the applicator member has a cavity passing therethrough, the cavity opening out onto each of the main application faces.

12. A method according to claim 1, wherein the applicator member comprises flocking.

13. A method according to claim 1, wherein a thickness of the applicator member increases in a monotonic manner, and passes through a single maximum on going away from the distal end of the applicator.

14. A method according to claim 1, wherein the applicator member comprises, in a plane in which a thickness of the applicator member reaches the greatest thickness, a cross-section that is circular.

* * * * *